US012480261B2

(12) United States Patent
Sajjadi Alehashem et al.

(10) Patent No.: US 12,480,261 B2
(45) Date of Patent: Nov. 25, 2025

(54) METHODOLOGY FOR VIBRATION AND NOISE CONTROL USING MODULAR RAIL PARTICLE DAMPER IN RAIL TRANSIT SYSTEMS

(71) Applicant: Shenzhen Research Institute of the Hong Kong Polytechnic University, Shenzhen (CN)

(72) Inventors: Seyed Masoud Sajjadi Alehashem, Shenzhen (CN); Yiqing Ni, Shenzhen (CN); Chao Zhang, Shenzhen (CN)

(73) Assignee: SHENZHEN RESEARCH INSTITUTE OF THE HONG KONG POLYTECHNIC UNIVERSITY, Shenzhen (CN)

( * ) Notice: Subject to any disclaimer, the term of this patent is extended or adjusted under 35 U.S.C. 154(b) by 857 days.

(21) Appl. No.: 17/732,231

(22) Filed: Apr. 28, 2022

(65) Prior Publication Data

US 2022/0349127 A1 Nov. 3, 2022

(30) Foreign Application Priority Data

Apr. 28, 2021 (CN) ..... 202110466428.5

(51) Int. Cl.
*E01B 19/00* (2006.01)

(52) U.S. Cl.
CPC ..... *E01B 19/003* (2013.01)

(58) Field of Classification Search
CPC ..... E01B 11/00; E01B 11/54; E01B 19/00; E01B 19/003
See application file for complete search history.

(56) References Cited

FOREIGN PATENT DOCUMENTS

| | | | | | |
|---|---|---|---|---|---|
| CN | 105908581 | A | | 8/2016 | |
| CN | 110318304 | A | | 10/2019 | |
| CN | 110409228 | A | * | 11/2019 | ..... E01B 19/003 |
| CN | 110424196 | A | | 11/2019 | |
| CN | 112031196 | A | | 12/2020 | |
| WO | WO2005012641 | A1 | | 2/2005 | |

* cited by examiner

*Primary Examiner* — Robert J McCarry, Jr.
(74) *Attorney, Agent, or Firm* — MUNCY, GEISSLER, OLDS & LOWE, P.C.

(57) ABSTRACT

Disclosed is a novel methodology for vibration and noise control using modular rail particle damper in rail transit systems, which comprises steps: determining a target damper module corresponding to a vibration frequency content of a rail system, multiple target damper modules are adopted; connecting target damper module by adopting a connecting module so as to form a rail particle damper; and installing rail particle damper at rail web to conduct vibration and noise control on the rail system. Target damper modules are connected through connecting modules to form an integrated rail particle damper, a wide vibration mitigation frequency range is formed by adopting different target damper modules, and therefore rail particle damper is suitable for reducing broadband vibration and noise generated in rail systems under different operating environments.

10 Claims, 18 Drawing Sheets

METHODOLOGY FOR VIBRATION AND NOISE CONTROL USING MODULAR RAIL PARTICLE DAMPER IN RAIL TRANSIT SYSTEMS

CROSS-REFERENCE TO RELATED APPLICATIONS

This application claims priority to Chinese Patent Application No. 202110466428.5, filed on Apr. 28, 2021. The content of all of which is incorporated herein by reference.

FIELD OF THE DISCLOSURE

The present application relates to the technical field of dampers, in particular to a novel methodology for vibration and noise control using modular rail particle damper in rail transit systems.

BACKGROUND

Rail noise caused by violent wheel-rail interaction is always a global concern. A plurality of efforts has been adopted to reduce the noise, including using a noise barrier, an acoustic absorbing material, and other passive methods. In the prior art, the rail damper acts as a prevention method for noise source, which has been widely applied by suppressing the rail vibration. However, the existing rail dampers work only in a relatively limited vibration frequency range, insufficient to handle a broadband noise (500-2000 Hz) generated in different rail operating environments.

Therefore, the current technology still has several defects and needs improvement and development.

BRIEF SUMMARY OF THE DISCLOSURE

According to the defects in the prior art described above, the present application provides a novel methodology for vibration and noise control using modular rail particle damper in rail transit systems to solve a problem in the prior art that damper cannot handle the broadband noise generated in different rail operating environments.

The technical solution of the present application to solve the technical problems is as follows:

A vibration and noise control method for rail transit based on a modular rail particle damper, which includes:

Determining a target damper module corresponding to a vibration frequency component according to the vibration frequency component of a rail; wherein a plurality of target damper modules are adopted;

Adopting a connecting module to connect a plurality of the target damper modules to form an integrated rail particle damper;

Installing the rail particle damper at a rail web to perform a vibration control to the rail.

In the vibration and noise control method for rail transit based on the modular rail particle damper, the step of determining the target damper module corresponding to the vibration frequency component according to the vibration frequency component of the rail includes:

Adopting an operating frequency of a candidate damper module to match the vibration frequency component and taking the candidate damper module as the target damper module when the vibration frequency component is well matched.

In the vibration and noise control method for rail transit based on the modular rail particle damper, the candidate damper module includes:

A plurality of enclosures;

A plurality of grids configured to divide the enclosures into a plurality of sub-enclosures; and A plurality of particles filled in the sub-enclosure.

The step of adopting the operating frequency of the candidate damper module to match the vibration frequency component, and taking the candidate damper module as the target damper module when the vibration frequency component is well matched, includes:

Adjusting a number and a shape of the sub-enclosure, a material of the particles, and a volume fraction of particles poured into the sub-enclosure to adjust the operating frequency of the candidate damper module, to match the vibration reducing frequency component, and when the vibration frequency component is well matched, taking the candidate damper module as the target damper module.

In the vibration and noise control method for rail transit based on the modular rail particle damper, the particles are solid particles and/or liquid medium or combination of both; the volume fraction of the sub-enclosure occupied by the particles is 0-90%.

In the vibration and noise control method for rail transit based on the modular rail particle damper, the candidate damper module has an assembly hole arranged;

The connecting module comprises an end cap, an assembly bolt, and an assembly nut.

Further, the step of adopting the connecting module to connect the plurality of the target damper modules to form an integrated rail particle damper includes:

Applying the assembly bolt to passing through the assembly hole in each of the target damper modules in sequence; wherein a plurality of openings of the enclosures in all of the target damper modules are oriented in the same direction;

Applying the end cap to closing the opening of the enclosure in the target damper module;

Adopting the assembly nut to lock both ends of the assembly bolt to fix each of the target damper modules, to form an integrated rail particle damper.

In the vibration and noise control method for rail transit based on the modular rail particle damper, the rail particle damper is fixed at the rail web by at least two fixtures.

In the vibration and noise control method for rail transit based on the modular rail particle damper, the fixture includes:

A base;

An L-shape part that is connected to the base with a pivot mechanism makes it possible to rotate freely;

The L-shape part comprises:

A horizontal portion and a vertical portion are connected, the horizontal portion limits an upper surface of the rail particle damper, and the vertical portion limits an outer surface of the rail particle damper;

The rail web limits an inner surface of the rail particle damper, and a rail foot limits a lower surface of the rail particle damper.

In the vibration and noise control method for rail transit based on the modular rail particle damper, the base is a U-shape seat, and the rail foot locates in the U-shaped seat;

Two rail particle dampers are adopted, and the two rail particle dampers are arranged symmetrically;

Two L-shaped parts are adopted, and the two L-shaped parts are arranged symmetrically.

In the vibration and noise control method for rail transit based on the modular rail particle damper, the horizontal portion is in contact with the upper surface of the rail particle damper; and the L-shaped part has a first mounting screw arranged, which is in contact with the outer surface of the rail particle damper;

The base has a second mounting screw arranged, which is in contact with the outer surface of the rail particle damper.

Beneficial effects: By adopting a connecting module to connect each target damper module, an integrated rail particle damper is formed. By adopting different damper modules, a relatively wide frequency range for the vibration control is formed; thus, it suits for reducing the broadband noise generated in the operating environment of the rail.

DESCRIPTION OF NUMERALS IN THE FIGURES

1. Rail; 2. Rail particle damper; 3. Fixture; 4. Candidate damper module; 40. Target damper module; 5. End cap; 6. Assembly bolt; 7. Assembly nut; 8. Assembly hole; 9. Enclosure; 10. Sealing gasket; 11. Particles; 12. Base; 13. Second mounting screw; 14. First mounting screw; 15. L-shaped part; 16. Pivot screw.

DETAILED DESCRIPTION OF EMBODIMENTS

In order to make the purpose, technical solution, and the advantages of the present application clearer and more explicit, detailed descriptions of the present application are further stated herein, referencing the attached drawings and some embodiments of the present application. It should be understood that the detailed embodiments of the application described here are used only to explain the present application instead of limiting the present application.

Referencing FIG. 1-FIG. 20, the present disclosure provides a vibration and noise control method for rail transit based on a modular rail particle damper.

Figure 1:
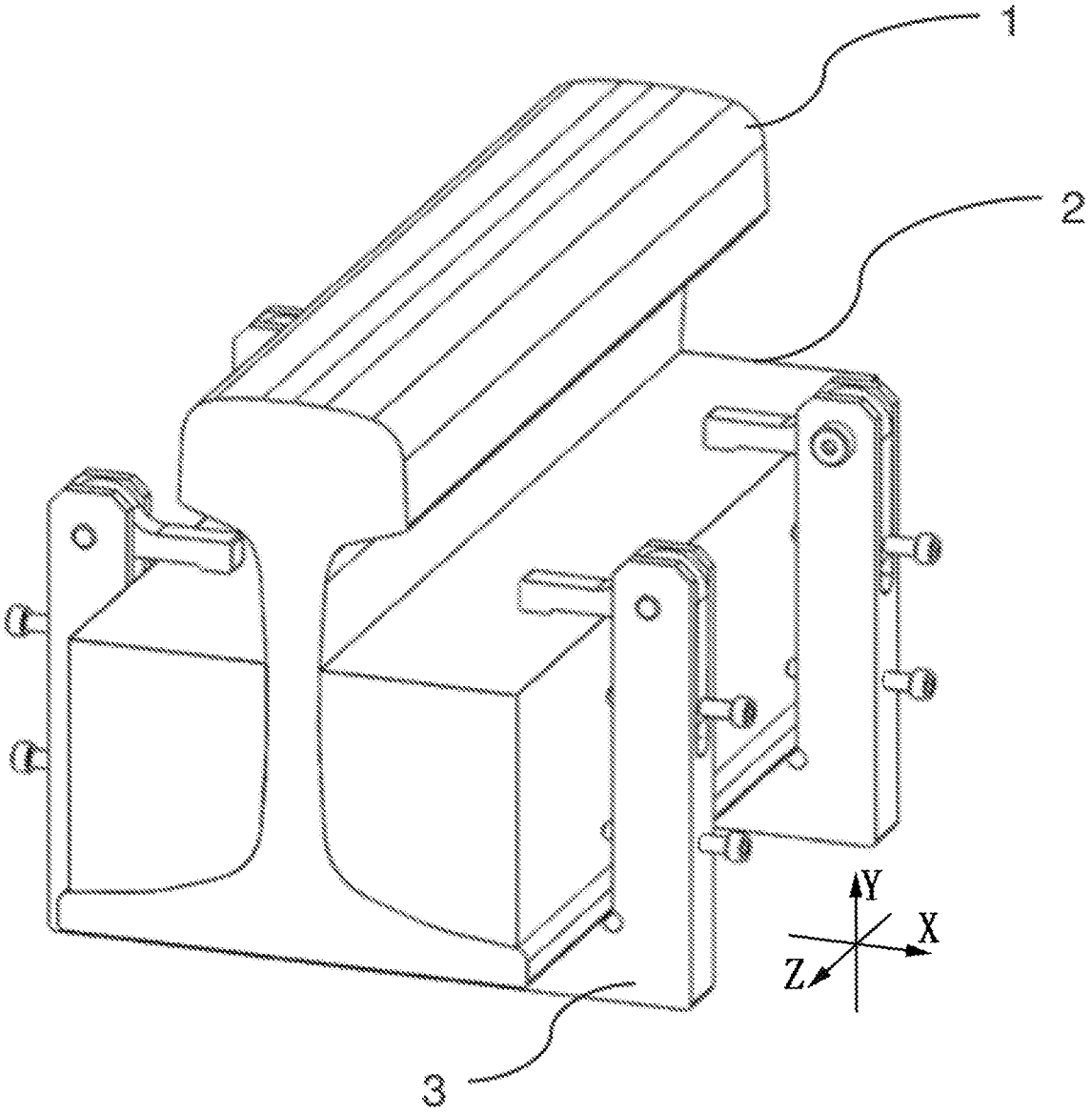
FIG. 1 illustrates a 3D diagram of a rail system in the present disclosure.

The vibration and noise control method for rail transit based on the modular rail particle damper is applied to a rail system, as shown in FIG. 1. The rail system in the present disclosure comprises:

A rail 1:

A modular rail particle damper is installed on the rail 1.

The modular rail particle dampers are installed on the rail 1 to mitigate the noise and vibration in railways.

As shown in FIG. 1 to FIG. 6, the rail particle damper 2 is developed for the rail system based on the modular design in the present disclosure, and it is arranged in a position of a rail web of the rail 1; the rail particle damper 2 comprises:

A target damper module 40, there are a plurality of the target damper module; and A connecting module connects to the plurality of target damper modules detachably.

The vibration and noise control method in the present embodiment comprises:

S100. Determining a target damper module corresponding to a vibration frequency component according to the vibration frequency component of a rail; wherein there are a plurality of target damper modules;

S200. Adopting a connecting module to connect a plurality of the target damper modules to form an integrated rail particle damper;

S300. Installing the rail particle damper at the rail web to perform a vibration control to the rail.

Due to a plurality of different environments that the rail locates in when a vehicle is running on the rail, a vibration frequency component is different. Therefore, when it is needed to damp the rail, obtaining the vibration frequency component of the rail first, and determining the target damper module corresponding to the vibration frequency component according to the vibration frequency component, then adopting the connecting module to connect the target damper modules, before obtaining the rail particle damper, which is connected to the position of the rail web, so that it is possible to perform the vibration and noise control for the rail.

Before the step of S100, the vibration and noise control method comprises:

S10. Obtaining the vibration frequency component of the rail.

Adopting a frequency detector to detect the vibration frequency component of the rail, in an embodiment, adopting an accelerometer to detect the vibration frequency component of the rail; the frequency detector is arranged on a railhead and/or a rail foot, in one embodiment, the accelerometers are installed on an upper surface and both sides of the railhead, as well as on a lower surface of the rail foot, while the accelerometers detect the vibration frequency contents of the rail system.

The vibration frequency components of the rail are obtained through the frequency detector. Since the rail particle damper 2 abuts against the rail web and the rail foot, the frequency detector can also be installed on the rail web and/or the rail foot so that the vibration frequency components detected by the frequency detector can accurately reflect the vibration frequency components of the position where the rail particle damper 2 is located, so that the rail particle damper 2 can fully dampen the rail.

It is noted that, by the connecting module, each of the target damper modules is connected to form the rail particle damper 2. By adopting different target damper modules, it is possible to form a relatively wide frequency range for the vibration control to be suitable for reducing the broadband noise generated in a rail operating environment. Different target damper modules may be combined to achieve different vibration mitigation effects by adopting a plurality of modularized target damper modules.

The rail particle damper 2 connects to the position of the rail web of the rail 1. When a vehicle is running on the rail 1, the rail 1 will generate vibrations and noises, and the rail 1 produces different broadband noises in different operating environments. Thus adopting the damper of the present disclosure can be suitable for the vibration and noise control in a broadband vibration frequency range to reduce a broadband vibration and noise generated by the rail 1.

It is understandable that, by selecting a plurality of different candidate damper modules and a plurality of particles therein, a plurality of target damper modules with a different damping frequency range are obtained so that the rail particle damper 2 has a relatively wide range of vibration mitigation frequencies.

The step S100 comprises:

S110. Adopting an operating frequency of a candidate damper module to match the vibration frequency component and taking the candidate damper module as the target damper module when the vibration frequency component is well matched.

A candidate damper module 4 refers to a damper module that can be installed optionally; that is, there are a plurality of kinds of the candidate damper modules 4, and not all of the candidate damper modules 4 are installed on the rail; instead, some of the candidate damper modules 4 are selected according to the vibration frequency components of the rail, and installed onto the rail as a target damper module 40. Adopting the operating frequencies of the candidate damper modules 4 to match the vibration frequency components, that is, combining the operating frequencies of several candidate damper modules 4 to form a matched vibration frequency component, if the vibration frequency components coincide, that means the match is accomplished. To achieve a better vibration mitigation effect, these candidate damper modules 4 may be applied as the target damper modules 40.

Figure 7:
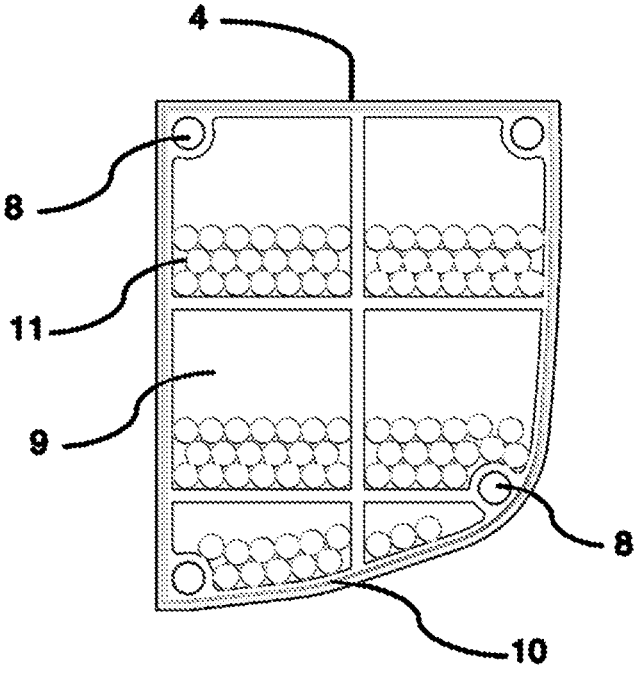
FIG. 7 illustrates a first configuration diagram on the candidate damper module in the present disclosure.
Figure 8:
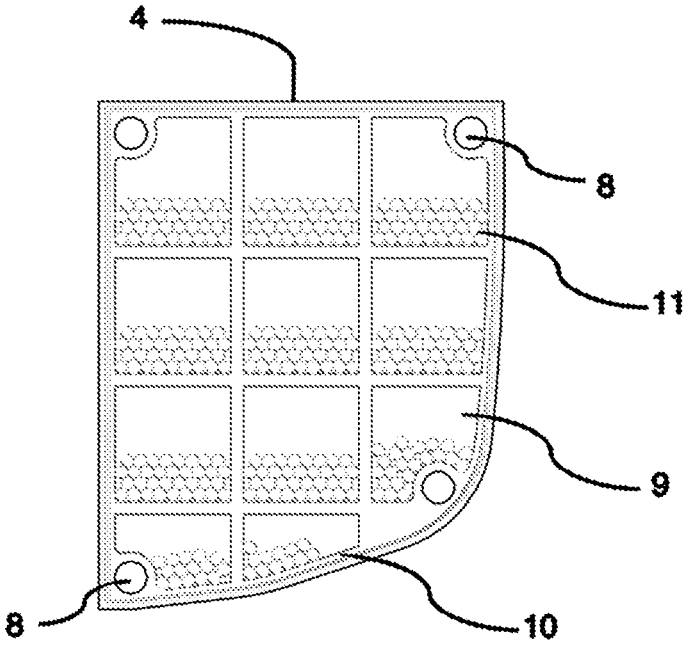
FIG. 8 illustrates a second configuration diagram of the candidate damper module in the present disclosure.
Figure 9:
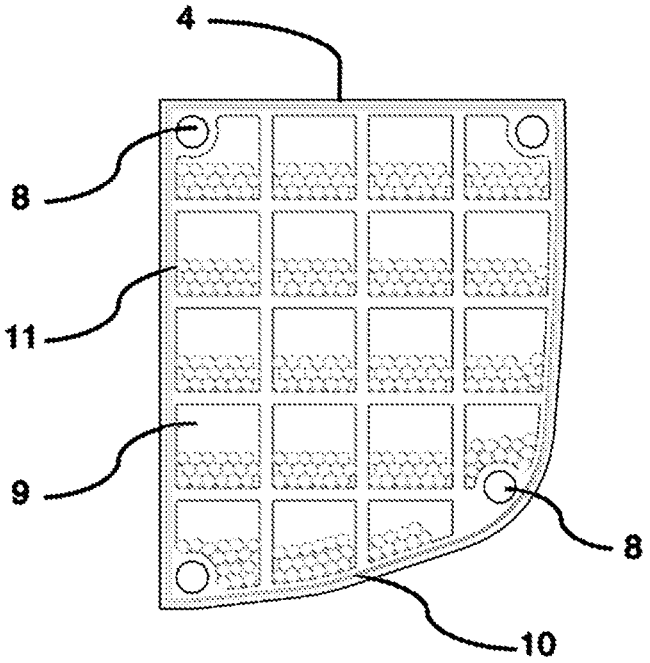
FIG. 9 illustrates a third configuration diagram of the candidate damper module in the present disclosure.

An implementation method of the embodiments of the present disclosure, as shown in FIG. 7-FIG. 9, the candidate damper module 4 comprises:

A plurality of enclosures 9;

A plurality of grids applied to dividing the enclosure 9 into a plurality of sub-enclosures; and A plurality of particles 11, filled in the sub-enclosure.

The enclosures 9 connect with the connecting module, and the grids are arranged in the enclosures 9 to divide the enclosures 9 into a plurality of sub-enclosures. A plurality of the target damper modules are arranged along a longitudinal direction of the rail 1; since each target damper module is arranged along the longitudinal direction of the rail 1, an X-direction is defined as perpendicular to the longitudinal direction of the rail 1 in the horizontal plane, a Y-direction is defined as the vertical direction, and a Z-direction is defined as the longitudinal direction of the rail 1. The dimensions of damper modules can be adjusted in three different directions (X/Y/Z) to control a vibrational frequency range thereof.

The number and the size of the sub-enclosures in the X-direction and the particles therein can be adjusted to tune the working frequency of the damper modules in the X-direction. The arrangement of the sub-enclosures in the Y-direction and/or the particles therein can be adjusted to tune the working frequency of the damper modules in the Y-direction. The arrangement of the sub-enclosures in the Z-direction and/or the particles therein can be adjusted to tune the working frequency of the damper modules in the Z-direction.

It can be understood that, in a plurality of different candidate damper modules, both the grids and the particles can be changed, so a corresponding operating frequency of a different candidate damper module is different from each other, and the operating frequency of the different candidate damper module in the same direction (for example, the X-direction, the Y-direction or the Z-direction) is also different, by adopting the candidate damper module in the present disclosure can easily adjust the working frequencies of the damper in different directions to match the vibration frequency contents of the rail.

The particles 11 refers to a plurality of particles applied to damping, and the particles are solid particles and/or liquid medium or combination of both; thus the particle 11 can be any of or a plurality of solid particles, any one or a plurality of liquid medium, or a mixture thereof. The solid particles can be made of any material; the material of the solid particles comprises but is not limited to metal, ceramics, gravel, plastic, and more. The solid particles can be in any shape, and the shape of the solid particles comprises a sphere shape, granule, powder, and more. In an embodiment, the particle 11 adopts at least one of a metal particle, a ceramic particle, a plastic particle, sand, and powder. The liquid medium can be any of or a plurality of liquid oils, any one or a plurality of silicone oils, and more.

When the target damper module 40 vibrates, between the particles 11, between the particles 11, the grids, and an inner wall of the enclosure 9, a collision and a friction action against each other generates a damping action. By the collision and the friction action against each other during the particles 11 moving, the energy of a rail structure vibration is converted into heat energy or a plurality of other forms of the energy, to be consumed so as to achieve a purpose of damping, suppressing the vibration of the rail 1 and reducing the noise.

It can be understood that when adopting a plurality of particles 11 in granular is adopted, it is possible to absorb the vibration energy in a wider frequency, and the particles 11 in granular will not decline their own damping performance due to aging caused by a temperature change, that is, a change of a temperature in the operating environment will not affect a vibration mitigation performance of the target damper module 40; thus the rail particle damper in the present disclosure can be suitable for any operating environments.

The step S210 comprises:

S211, adjusting the number and the shape of the sub-enclosures, the material of the particles, and a volume fraction of the sub-enclosure occupied by the particles 11, so as to adjust the operating frequency of the candidate damper module 4, to match the vibration reducing frequency component, and when the vibration frequency component is well matched, taking the candidate damper module 4 as the target damper module 40.

When adjusting a damping effect of the candidate damper module 4, it is possible to adjust the number and the shape of the sub-enclosure, the material of the particles 11, and the volume fraction of the particles 11 in the sub-enclosure to adjust the operating frequency of the candidate damper module 4. While different candidate damper modules 4 are adopting a different number of the sub-enclosures, different material of the particles 11 and different volume fractions of the particles 11 in the sub-enclosures, that is, taking and connecting the candidate damper modules 4 with different operating frequencies as the target damper module 40 by the connecting module, before obtaining the rail particle damper 2, which may be suitable for a wider vibration mitigation frequency. It should be noted that the rail particle damper 2 may have a plurality of the same target damper module 4, that is, superimposing the working frequency of the same target damper module for a match.

There is a plurality of sub-enclosures; the volume fraction of the sub-enclosure occupied by the particles 11 is 0-90%. As shown in FIG. 7, the number of the sub-enclosures is 6, as shown in FIG. 8, the number of the sub-enclosures is 8, and as shown in FIG. 9, the number of the enclosure is 19.

Figure 12:
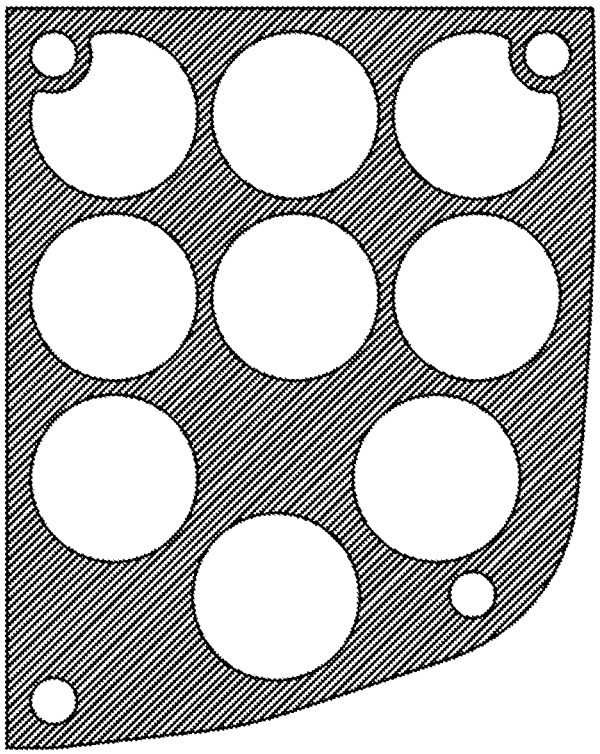
FIG. 12 illustrates a structural schematic diagram of the candidate damper module with round grid holes in the present disclosure.
Figure 13:
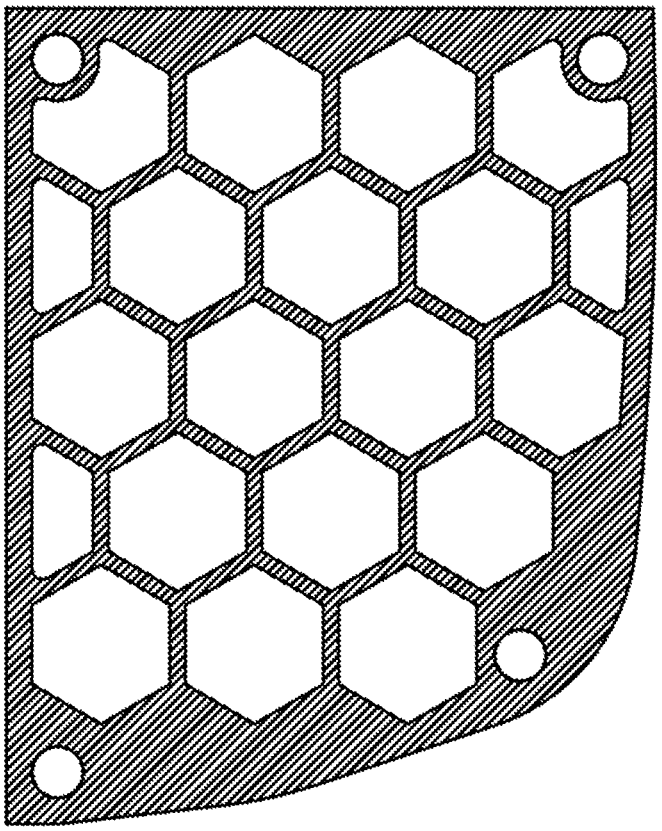
FIG. 13 illustrates a structural schematic diagram of the candidate damper module with hexagonal grid holes in the present disclosure.
Figure 14:
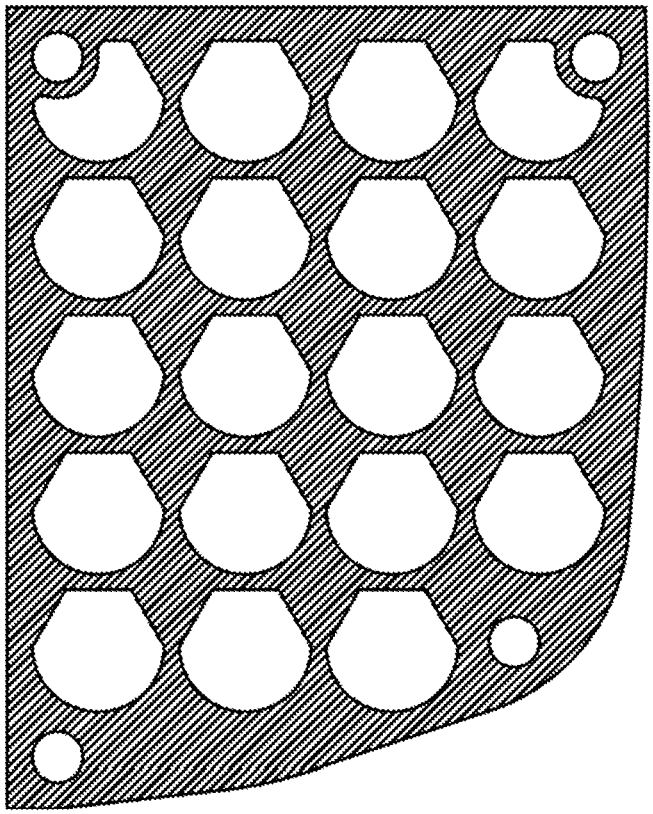
FIG. 14 illustrates the first structural schematic diagram of the damper module with irregular-shaped grid holes in the present disclosure.
Figure 15:
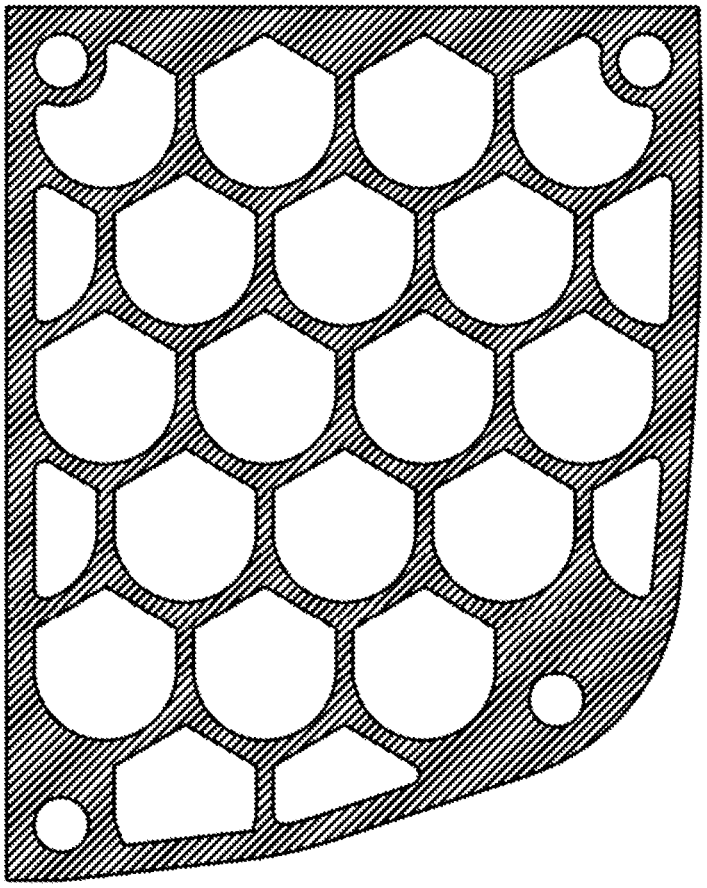
FIG. 15 illustrates a second structural schematic diagram of the damper module with irregular-shaped grid holes in the present disclosure.

A shape of the sub-enclosure can be any regular shape or any irregular shape, such as a regular shape including a rectangle, a circle, a triangle, a hexagon, and more. As shown in FIG. 7-FIG. 9, a rectangular sub-enclosure is adopted; as shown in FIG. 12, a circular sub-enclosure is adopted; and as shown in FIG. 13, a hexagonal sub-enclosure is adopted. It may further adopt a plurality of irregular shapes formed by a plurality of arcs and/or straight lines, as shown in FIG. 14, which is a shape formed by an arc and three straight lines, and as shown in FIG. 15, a shape formed by an arc and four straight lines.

In an implementation of the embodiment in the present disclosure, as shown in FIG. 7-FIG. 9, in order to facilitate disassembly of each target damper module 40, the candidate damper module 4 has an assembly hole 8 arranged.

The connecting module comprises:

An end cap 5, an assembly bolt 6, and an assembly nut 7.

The assembly bolt 6 passes through the assembly hole 8, and the assembly nut 7 is arranged on both ends of the assembly bolt 6. All openings of enclosures 9 in all of the target damper modules 40 are oriented in a direction facing the end cap 5.

The step S200 comprises:

S210: passing the assembly bolt 6 through the assembly hole 8 in each of the target damper modules 40 in a sequence; wherein all openings of the enclosures 9 in all of the target damper modules 40 are oriented in the same direction;

S220: adopting the end cap 5 to close the opening of the enclosure 9 in the target damper module 40;

S230: adopting the assembly nut 7 to lock both ends of the assembly bolt 6, to fix each of the target damper modules 40, so as to form an integrated rail particle damper 2.

Figure 6:
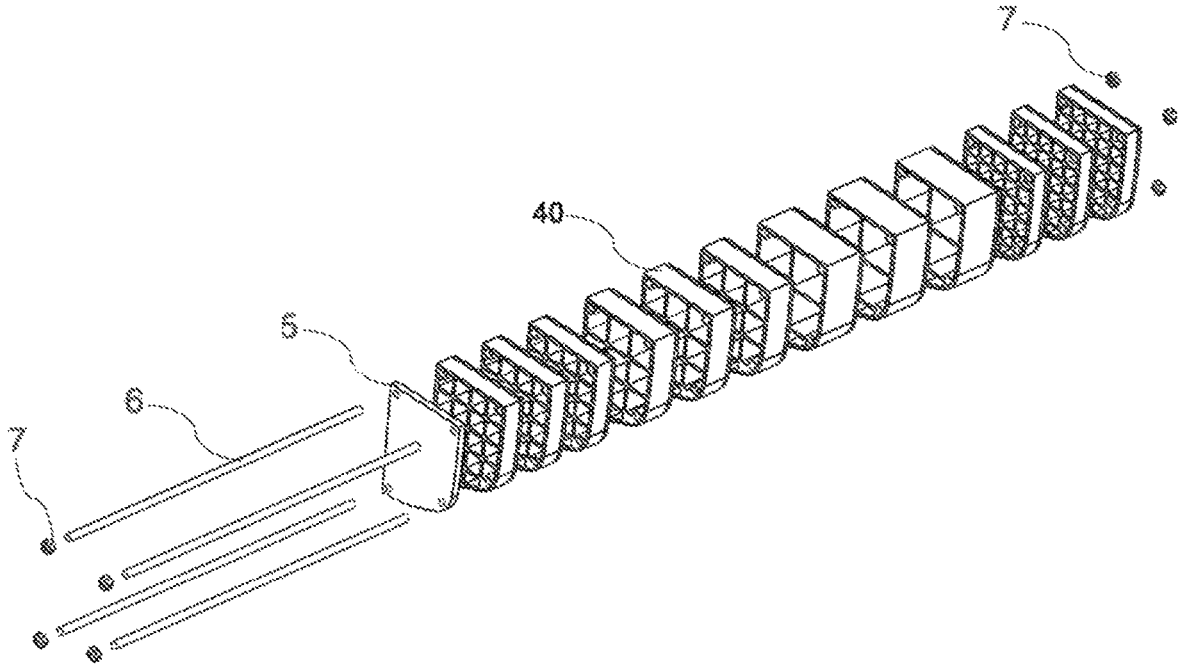
FIG. 6 illustrates an exploded diagram of the rail particle damper in the present disclosure.

As shown in FIG. 6, each of the target damper modules 40 is arranged in a sequence, adopting the end cap 5 to close the opening of the enclosure 9 in the first target damper module 40, then adopting the bottom of the enclosure of the first target damper module 40 to close the opening of the enclosure 9 in the second target damper module 40, which are arranged in a sequence, thus it is possible to close the opening of the enclosure 9 in each target damper module 40. The assembly bolt 6 passes through the assembly hole in each of the target damper modules 40 in a sequence and connects the target damper modules 40 together. A single target damper module 40 may have a plurality of assembly holes arranged, then a plurality of the assembly bolts 6 may also be arranged. As shown in FIG. 7 to FIG. 9, the target damper module 40 has four assembly holes arranged, located at four corners of the target damper module 40 respectively, and there are four assembly bolts 6, both ends of the assembly bolt 6 have the assembly nut 7 arranged, fixing each of the target damper modules 40 and the end cap onto the assembly bolt 6. The assembly nut 7 adopts a nut, and the assembly bolt 6 connects with the nut in a thread. Then, as long as the length of the assembly bolt 6 is greater than the sum of all thicknesses of all the target damper modules 40, no matter how many target damper modules 40 there are, they can be all fixed by the assembly bolt 6 and the nut, so as to facilitate an adjustment of a number of the target damper module 40.

In order to increase the sealing performance of each candidate damper module 4, enclosure 9 has a sealing gasket 10 arranged at an edge of the opening thereof.

Figure 2:
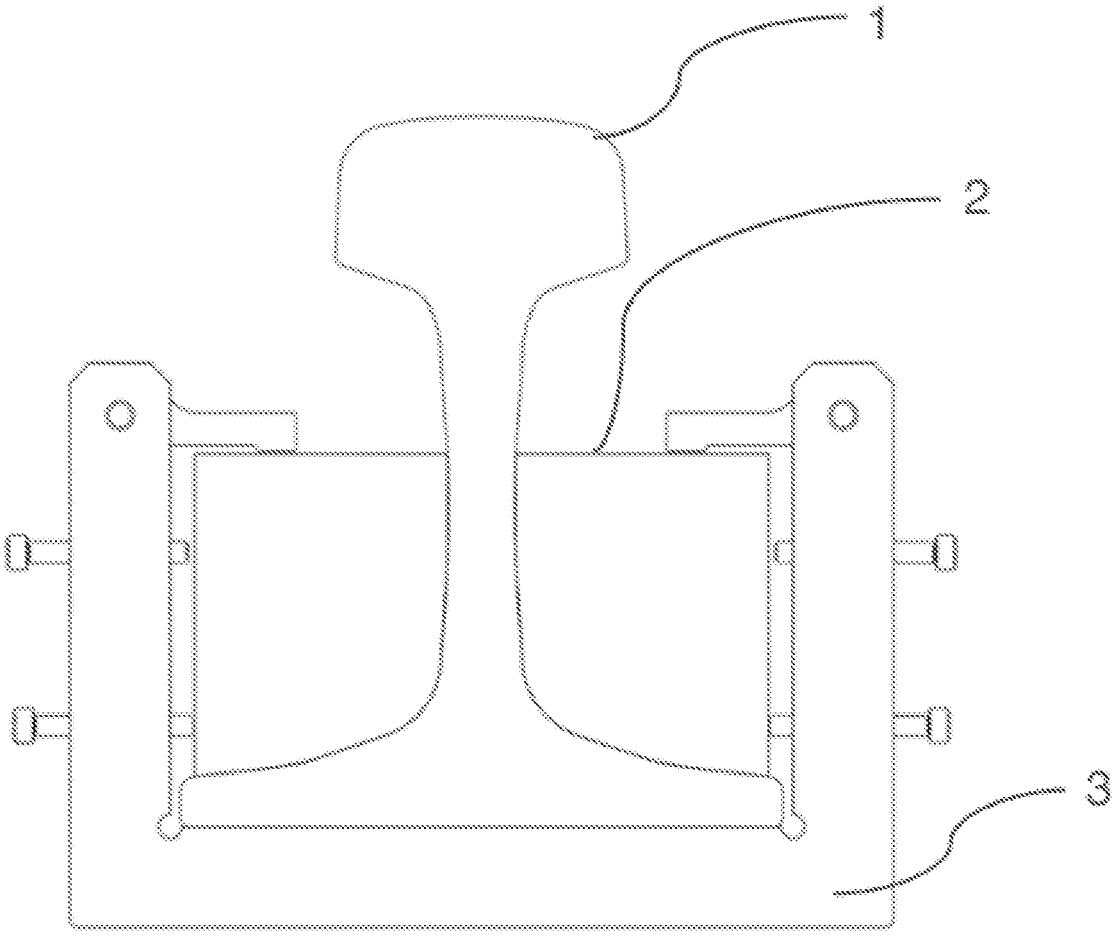
FIG. 2 illustrates a cross-sectional diagram of the rail system in the present disclosure.
Figure 3:
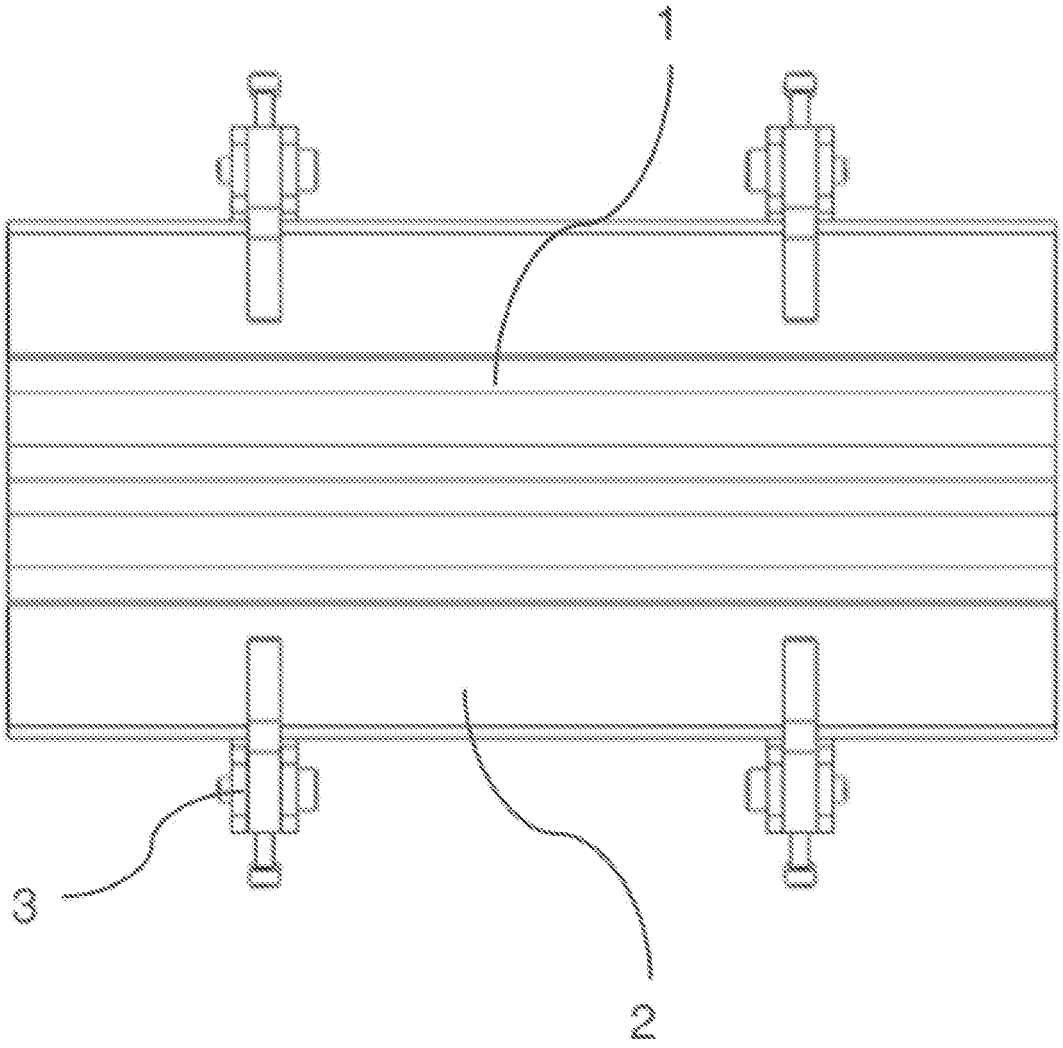
FIG. 3 illustrates a top view of the rail system in the present disclosure.
Figure 4:
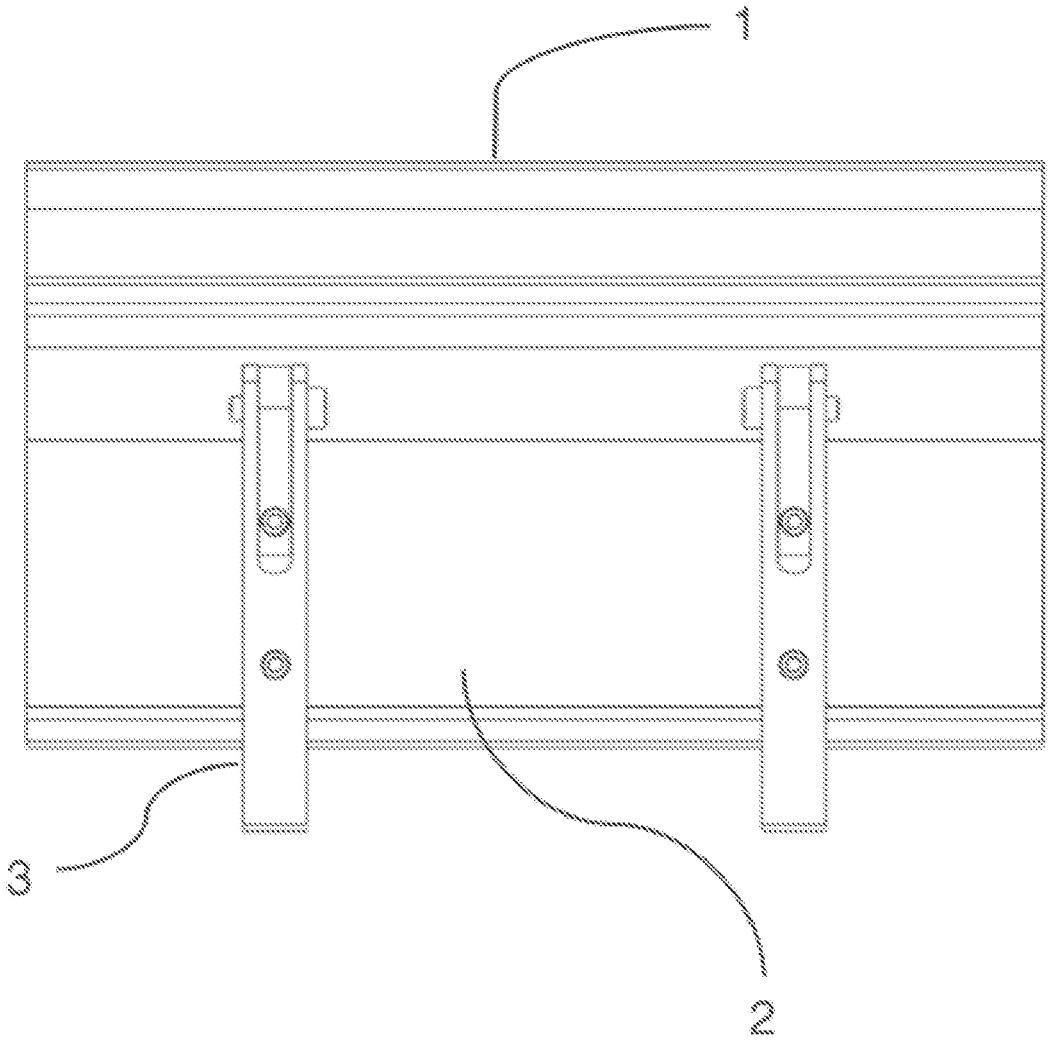
FIG. 4 illustrates a side view of the rail system in the present disclosure.
Figure 5:
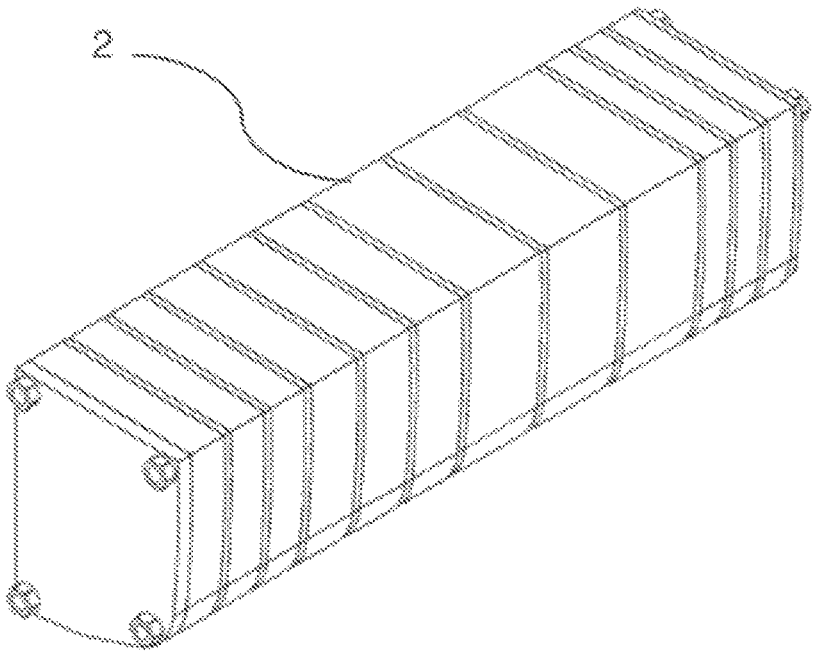
FIG. 5 illustrates a structural schematic diagram of the rail particle damper in the present disclosure.

In an implementation of the embodiment in the present disclosure, as shown in FIG. 1 to FIG. 2, the rail 1 is an I-shaped rail, and the I-shaped rail comprises:

A rail foot;

A rail web;

A railhead.

When connecting the rail particle damper 2 to the rail 1, the rail web and the rail foot are both abutting against the rail particle damper 2.

The I-shaped rail refers to a rail having an "I"-shaped cross-section. In order to realize a vibration control for the rail 1, the rail particle damper 2 connects with the rail web and the rail foot to facilitate the transmission of vibration to the rail particle damper 2. Of course, the rail particle damper 2 shall be spaced from the railhead to maintain a safe distance and ensure safe operation and maintenance.

It should be noted that, in order for a connection adaption between the rail particle damper 2, and the rail web and the rail foot of the rail 1, a contact surface between the rail particle damper 2, and the rail web and the rail foot adopts a smooth transition structure so that the rail particle damper 2 and the rail web and the rail foot are in full contact. That is, the shape of the rail particle damper 2 adapts to the shape of the rail, making the rail particle damper 2 in sufficient contact with the rail to ensure that the vibration of the rail can be transferred to the rail particle damper 2.

In an implementation of the embodiments in the present disclosure, as shown in FIG. 1-FIG. 4, FIG. 10, and FIG. 11, the rail particle damper is fixed at a position of the rail web of the rail 1 by at least two fixtures 3.

The rail particle damper 2 can connect directly to the rail 1 or be clamped onto the rail 1 by adopting the fixture 3. Clamping the rail particle damper 2 by the fixture 3 and the rail 1, further facilitates disassembling.

The step S300 comprises:

S310, adopting the fixture to clamp the rail particle damper onto the position of the rail web to reduce the vibration of the rail.

Figure 10:
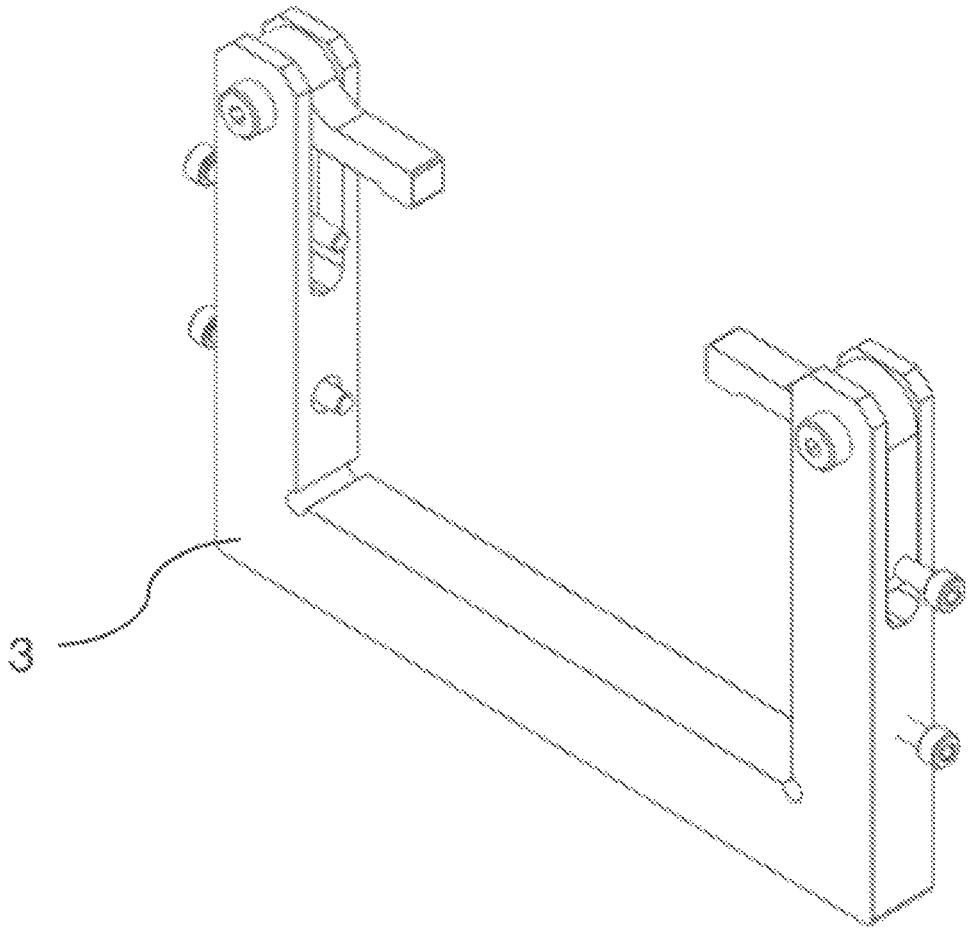
FIG. 10 illustrates a structural schematic diagram of the fixture in the present disclosure.
Figure 11:
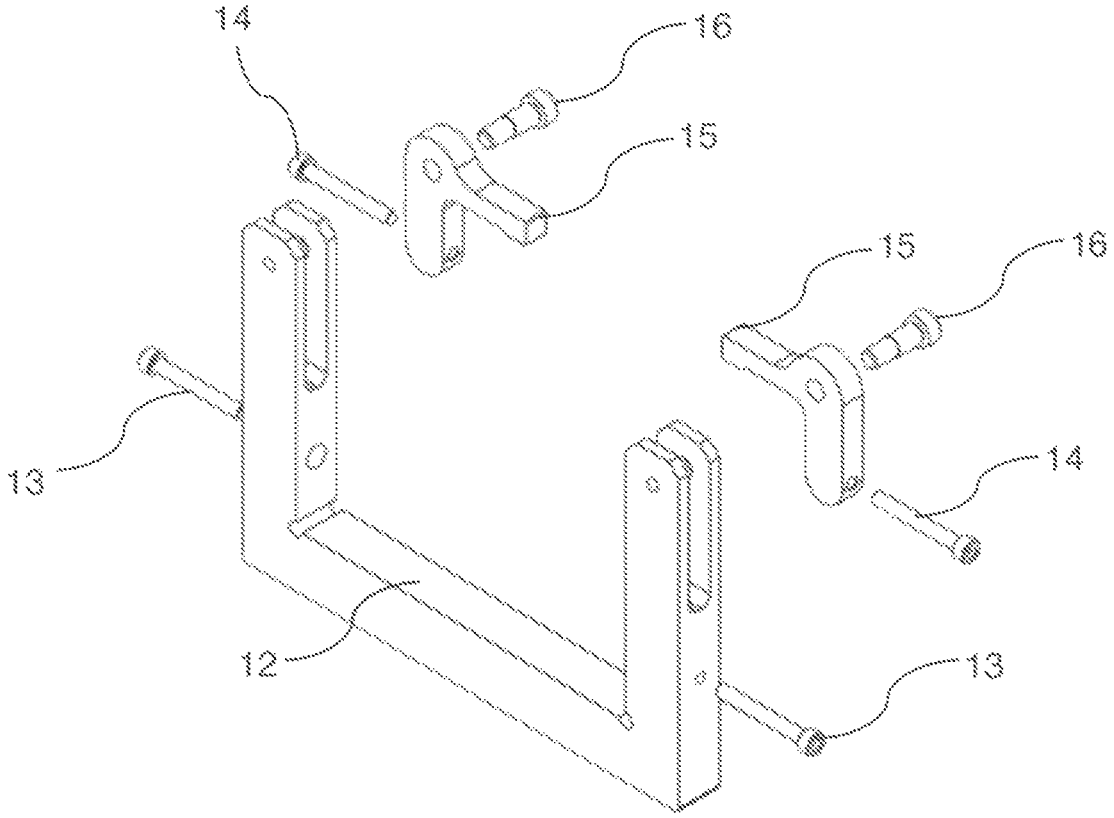
FIG. 11 illustrates an exploded diagram of the fixture in the present disclosure.

In an implementation of the embodiments in the present disclosure, as shown in FIG. 10-FIG. 11, the fixture 3 comprises:

A base 12;

An L-shaped part 15, connecting with the base 12 rotatably;

The L-shaped part 15 comprises:

A horizontal portion and a vertical portion are connected to each other, the horizontal portion limits the upper surface of the rail particle damper, and the vertical portion limits the outer surface of the rail particle damper;

The rail web limits the inner surface of the rail particle damper, and a rail foot limits the lower surface of the rail particle damper.

The inner surface of the rail particle damper 2 refers to the surface of the rail particle damper 2 facing the rail web, and the outer surface of the rail particle damper 2 refers to the surface of the rail particle damper 2 away from the rail web. As shown in FIG. 1 and FIG. 11, there is one rail particle damper on each side of the rail web. Taking the rail particle damper on the right side as an example, the rail particle damper is fixed to the rail by the fixtures. The rail particle damper 2 is prevented from moving along an X-direction and moving along a Y-direction by the L-shaped part 15, the second mounting screw 13, and the first mounting screw 14. It should be noted that the L-shaped part 15 is rotatably connected to the base 12, and the L-shaped part 15 comprises a horizontal portion and a vertical portion interconnected to each other. The horizontal portion locates above the rail particle damper 2. The vertical portion locates on an outer surface of the rail particle damper 2. When the rail particle damper 2 is fastened by the first mounting screw 14, the horizontal portion of the L-shaped part 15 is acted by a reaction force of the first mounting screw 14, before generating a resisting bending moment to bind the rail particle damper 2 to prevent it from continuing moving along the Y-direction. In the same way, the second mounting screw 13 is tightened at the same time, preventing the rail particle damper 2 from moving along the X-direction and pushing the rail particle damper 2 to move to a direction of the rail web before fitting closely to the rail web, so that the rail particle damper 2 is unable to continue moving in the X-direction.

It should be noted that the base 12 may be clamped on the rail 1. The L-shaped part 15 is rotatably connected to the base 12 through a pivot screw 16, and the pivot screw 16 is arranged detachably on the base 12.

In an implementation of the embodiments in the present disclosure, as shown in FIG. 10 and FIG. 11, in order to fully transfer the vibration of the rail 1 to the rail particle damper 2 and fix the rail particle damper 2 onto the rail web and the rail foot of the rail 1, the base 12 is arranged as a U-shaped seat. The rail foot is located in the U-shaped seat; two rail particle dampers 2, two of the rail particle dampers 2 are arranged on both sides of the rail web, respectively, and two of the rail particle dampers 2 are arranged symmetrically. There are two L-shaped parts 15, two of the L-shaped parts 15 are arranged on both sides of the rail web respectively, and two of the L-shaped parts are arranged symmetrically.

From both sides of the rail web of the rail 1, two rail particle dampers 2 are applied to reduce the vibration respectively, and the two rail particle dampers 2 are clamped by two L-shaped parts 15 respectively.

Since the base 12 is a U-shaped seat, it is understandable that there is no need to fix the base 12. The base 12 and the L-shaped part 15 surround and clamp the rail particle damper 2 and the rail foot together, and the base 12 cannot be moved; thus, there is no need to fix the base 12.

In an implementation of the embodiments in the present disclosure, as shown in FIG. 2, FIG. 10, and FIG. 11, the horizontal portion contacts the upper surface of the rail particle damper 2, the L-shaped part 15 has a first mounting screw 14 arranged, and the first mounting screw 14 contacts to the outer surface of the rail particle damper 2.

Since it is possible that there is a gap between the L-shaped part 15 and the rail particle damper 2, the rail particle damper 2 may sway in the gap and cannot transmit the vibration of the rail 1 sufficiently. Thus arranging the first mounting screw 14 onto the L-shaped part 15, and the first mounting screw 14 abuts against the rail particle damper 2, making the L-shaped part 15 also abut against the rail particle damper 2. In an embodiment, there is a gap between the vertical portion of the L-shaped part 15 and the rail particle damper 2, and the first mounting screw 14 is screwed to the vertical portion of the L-shaped part 15 when the first mounting screw 14 is screwed in and abuts against the rail particle damper 2, it is possible to drive the L-shaped part 15 to rotate, making the horizontal portion abut against the rail particle damper 2, thereby eliminating an influence of the gap between the vertical portion and the rail particle damper 2.

In an implementation of the embodiments in the present disclosure, as shown in FIG. 2, FIG. 10, and FIG. 11, the base 12 has a second mounting screw 13 arranged, and the second mounting screw 13 contacts the outer surface of the rail particle damper 2.

The base 12 has the second mounting screw 13 arranged, the second mounting screw 13 abuts against the rail particle damper 2, and by the second mounting screw 13, the rail particle damper 2 is further fixed. In an embodiment, the first mounting screw 14 connects with the base 12 in a thread, and the first mounting screw 14 abuts against a side of the rail particle damper 2 away from the rail web.

Figure 16:
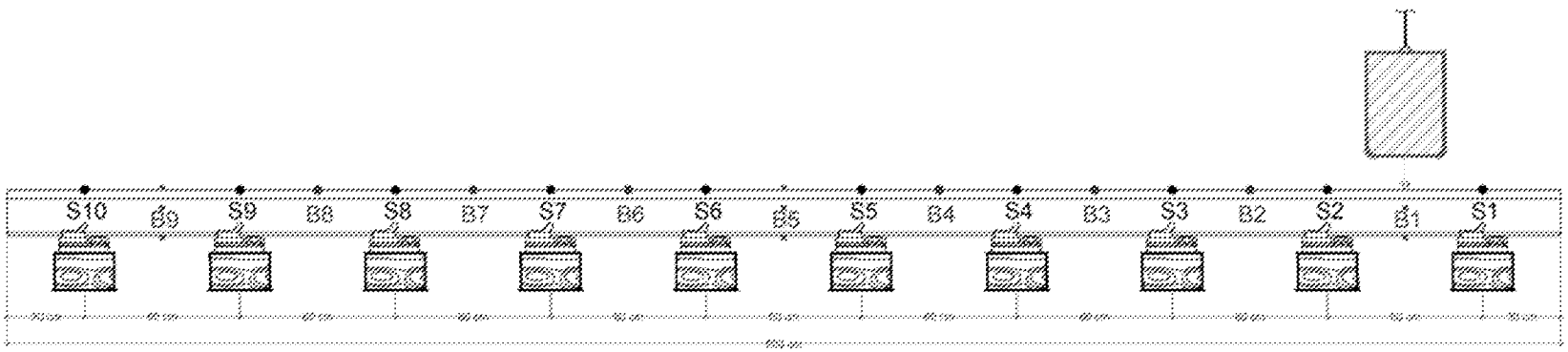
FIG. 16 illustrates a configuration diagram of a 6-meter full-scale rail dynamic testbed and an arrangement diagram of excitation points in the present disclosure.

In order to evaluate the performance of the vibration and noise control of the rail particle damper, a 6-meter full-scale rail dynamic testbed was built in a laboratory, as shown in FIG. 16. The test aims to study the effect of the volume fraction of the particles on various dynamic parameters of the vibration and noise control of the rail particle damper 2 on the rail 1. An impact hammer test and a dynamic vibration test were carried out using the testbed. B1-B9 are the number of rail cross-sections located at the midspan of the rail system between two adjacent fasteners, and S1-S10 are the numbers of rail cross-sections located at the support points of the fasteners. Wherein 9 groups of the modular rail particle damper are arranged on a plurality of positions of the cross-sections of B1-B9 in the rail. At the same time, an impact hammer test are carried out on the railhead at the B4 section of the rail. The vibration exciter is connected to the railhead at the B1 section applying dynamic excitation in the vertical direction to the rail system. Three accelerometers are installed on the railhead, the rail web, and the rail foot of a rail section, respectively, at each measurement point.

Figure 17:
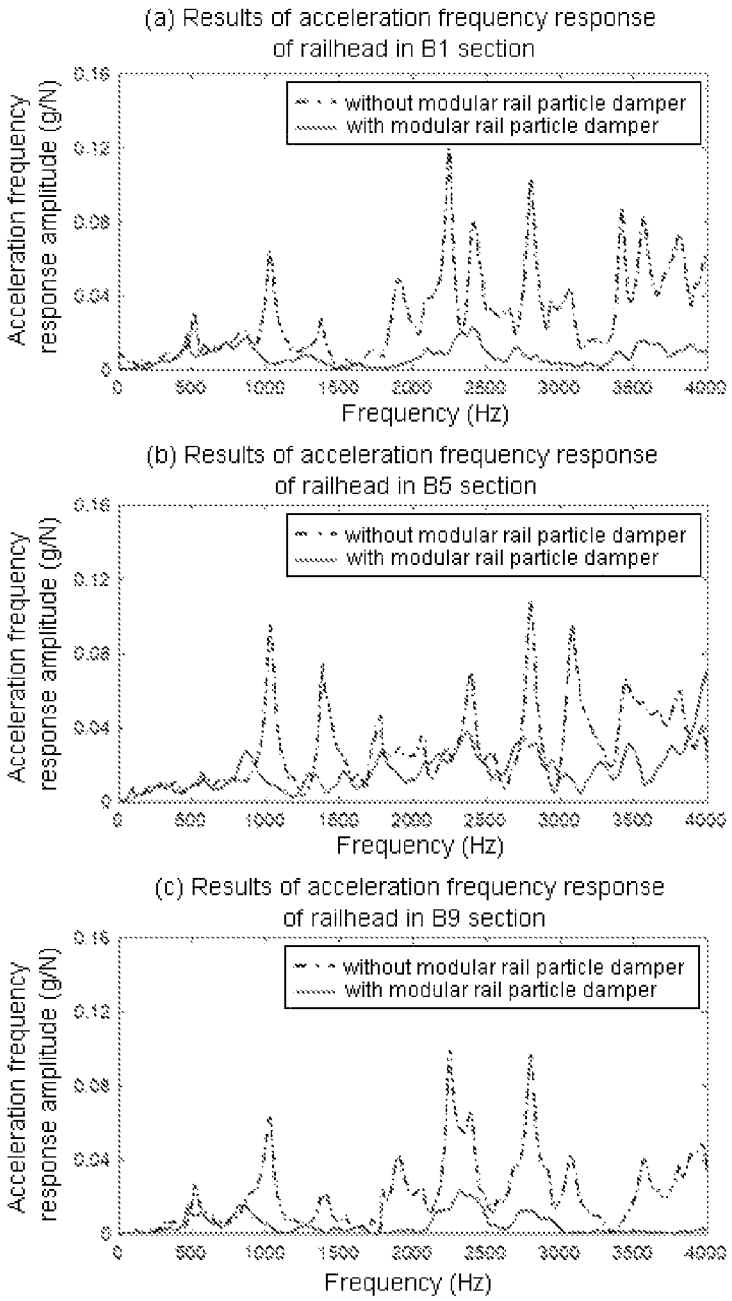
FIG. 17 illustrates a first vibration control test chart of a rail having a damper installed and having no damper installed in the present disclosure.

FIG. 17 illustrates the impact hammer test results of the acceleration frequency response function (FRF) measured at the positions of the railhead of the B1, B5, and B9 sections of the rail before and after installing the rail particle damper on the 6-meter full-scale rail dynamic testbed (the damping medium is a plurality of stainless steel balls with a diameter of 1.5 mm and a volume fraction of 50%) when performing an impact hammer test and the impacts are applied to the railhead in the B4 section of the rail.

Figure 18:
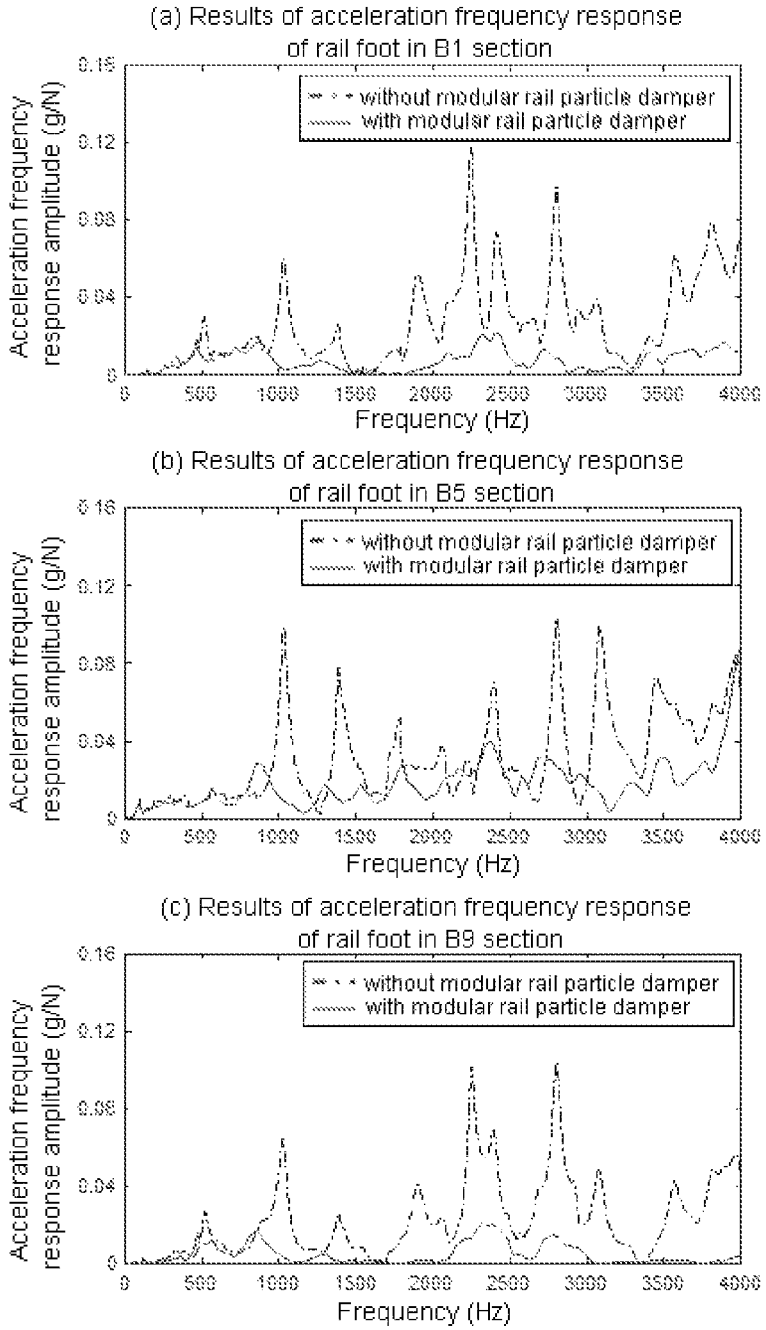
FIG. 18 illustrates a second vibration control test chart of the rail having the damper installed and having no damper installed in the present disclosure.

FIG. 18 illustrates the impact hammer test results of the acceleration frequency response function (FRF) measured at the positions of the rail foot of the B1, B5, and B9 sections of the rail before and after installing the rail particle damper on the 6-meter full-scale rail dynamic testbed (the damping medium is a plurality of stainless steel balls with a diameter of 1.5 mm and a volume fraction of 50%) when performing an impact hammer test and the impacts are applied to the railhead in the B4 section of the rail.

Figure 19:
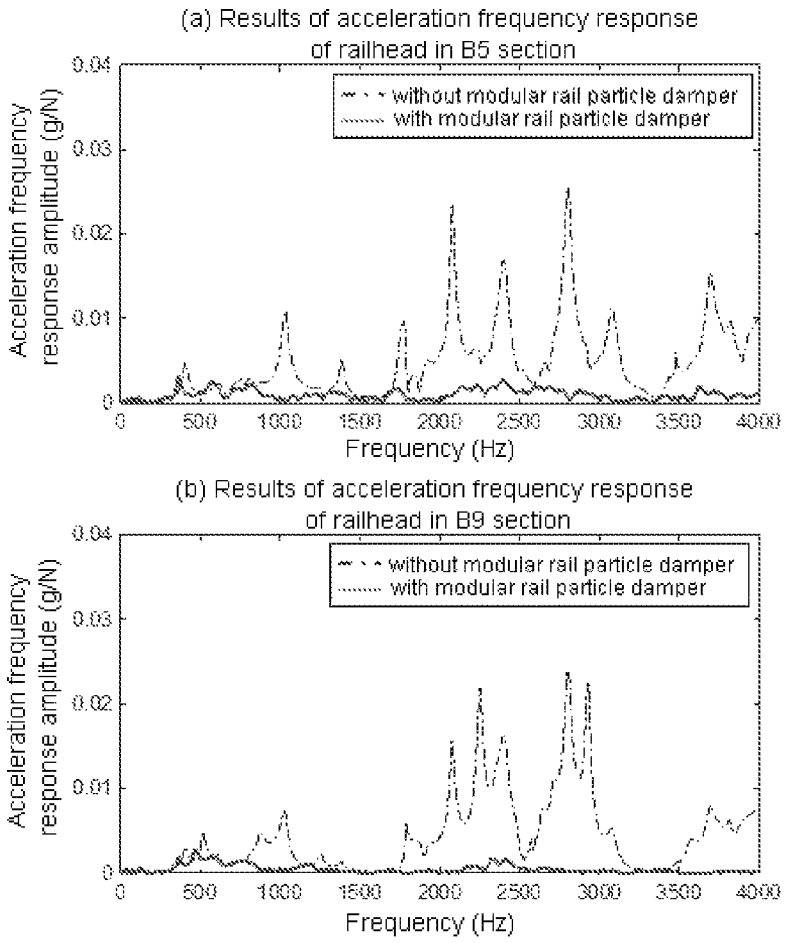
FIG. 19 illustrates a third vibration control test chart of the rail having the damper installed and having no damper installed in the present disclosure.

FIG. 19 illustrates the dynamic excitation test results of the acceleration frequency response function (FRF) measured at the positions of the railhead in the B5 and B9 sections of the rail before and after installing the rail particle damper on the 6-meter full-scale rail dynamic testbed (the damping medium is a plurality of stainless steel balls with a diameter of 1.5 mm and a volume fraction of 50%) when the dynamic exciter applies the vibration to the railhead at the B1 section of the rail.

Figure 20:
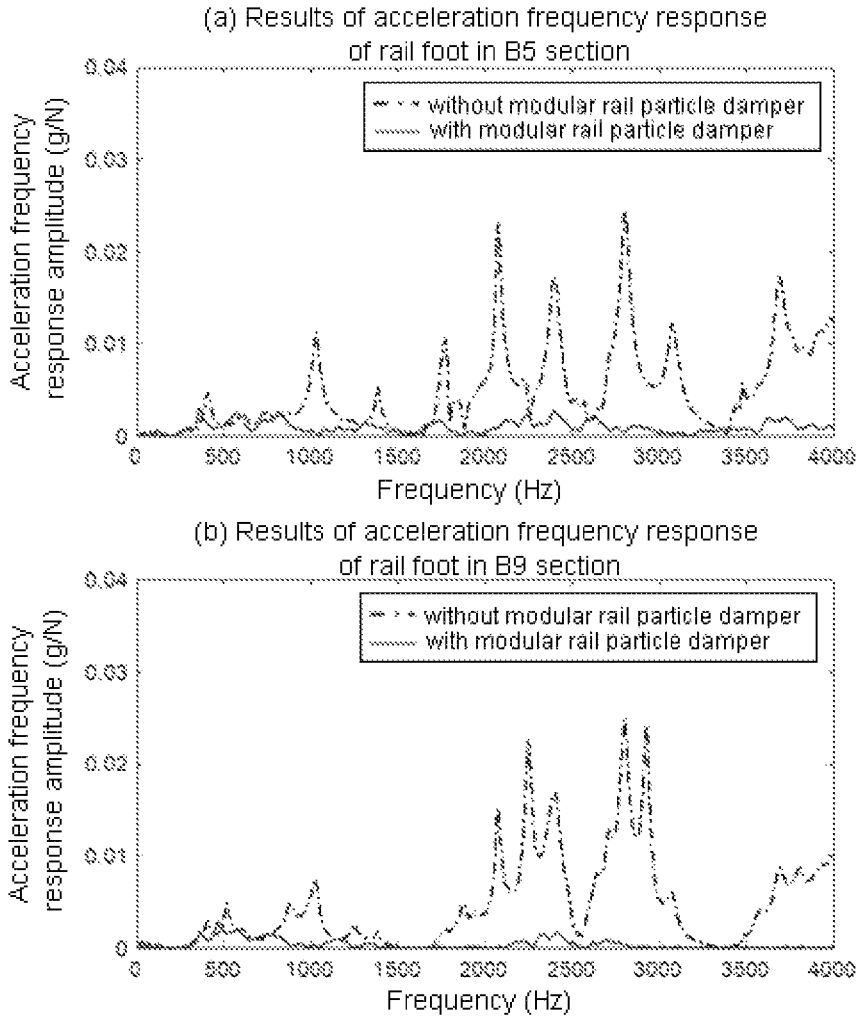
FIG. 20 illustrates a fourth vibration control test chart of the rail having the damper installed and having no damper installed in the present disclosure.

FIG. 20 illustrates the dynamic excitation test results of the acceleration frequency response function (FRF) measured at the positions of the rail foot in the B5 and B9 sections of the rail before and after installing the rail particle damper on the 6-meter full-scale rail dynamic testbed (the damping medium is a plurality of stainless steel balls with a diameter of 1.5 mm and a volume fraction of 50%) when the dynamic exciter applies the vibration to the railhead at the B1 section of the rail.

It can be seen from analyzing a plurality of test results in FIG. 17-FIG. 20 that by adopting a sub-enclosure with a specifically designed shape and size filled with a certain amount of particles with a particular material and mounting the rail particle damper on the rail system, it is possible to make a broadband vibration of the rail at 100-4000 Hz decrease drastically; in particular, the rail particle damper can significantly eliminate a pinned-pinned resonance frequency at 800-1200 Hz (the frequency band of the primary source of the rolling noise) of a rail system. All results listed above have fully demonstrated the rail particle damper's effectiveness in controlling the rail system's vibration and noise.

The vibration and noise control method disclosed by the present disclosure has a plurality of following advantages:

1. An installation of the modular rail particle damper can be achieved quickly and easily by replacing different candidate damper modules to modify design parameters related to vibration and noise control. The candidate damper modules of different sizes are mass-produced in advance. A plurality of corresponding candidate damper modules is selected and combined according to a vibration characteristic of a different rail system. Compared with a traditional integrated design of the rail particle damper for a rail, the production efficiency is improved, and a production cost is saved.

2. The candidate damper modules have different sizes of the enclosure and different combinations of the particles (different sizes, shapes, materials, and filling volume fractions). Thus a modular rail particle damper is easy to assemble.

3. In the modular rail particle damper, the size of the candidate vibration mitigation enclosure can be optimized in three directions to adapt to the requirement of the vibration and noise control of different rail systems.

4. A specific design of the fixture makes mounting and dismounting the modular rail particle damper more convenient.

5. The modular rail particle damper is less sensitive to changes the environmental conditions (such as temperature and more) or the rail system condition, having better durability.

6. The modular rail particle damper can be more easily configured to control broadband noise and vibration under different rail system conditions.

7. The fixtures are safe and reliable; 6 contact points on each side of the rail are provided (two contact points of the horizontal portions, two contact points of the first fastener, and two contact points of the second fastener) to ensure the vibrations of the rail are transmitted adequately to the modular rail particle damper.

8. A damping characteristic of each damper module for the rail can be easily adjusted by changing the volume fraction of the filling material in the enclosure of each candidate damper module.

9. The modular rail particle damper is assembled by several candidate damper modules with similar or different dimensions. Combining with vibration and noise characteristics of the rail in an actual application, by adjusting the size of the enclosure in the damper module for the rail and different particles filled in the enclosure, the performance of the rail particle damper can be mainly optimized, having a particular adaptive ability, and meeting a specification of the vibration and noise control for various rail systems.

It should be understood that the application of the present application is not limited to the above examples listed. Those skilled in the art can improve or change the applications according to the above descriptions. All of these improvements and transforms should belong to the scope of protection in the appended claims of the present application.

What is claimed is:

1. A vibration and noise control method for rail transit based on a modular rail particle damper, wherein comprising:

detecting a vibration frequency component of a rail by a frequency detector;

configuring a plurality of target damper modules, each of the target damper modules corresponding to a different frequency characteristic of the vibration frequency component of the rail;

connecting the plurality of the target damper modules side by side along a longitudinal direction of the rail by a connecting module to form a rail particle damper;

installing the rail particle damper at a rail web of the rail to perform vibration and noise control to a rail system.

2. The vibration and noise control method for rail transit based on the modular rail particle damper according to claim 1, wherein the step of determining the target damper module corresponding to the vibration frequency component according to the vibration frequency component of the rail system, comprising:

selecting, from a plurality of damper modules having different operating frequencies, a candidate damper module having an operating frequency that matches the vibration frequency component and taking the candidate damper module as the target damper module when the vibration frequency component is well matched.

3. The vibration and noise control method for rail transit based on the modular rail particle damper according to claim 2, wherein the candidate damper module comprising:

a plurality of enclosures;

a plurality of grids configured to divide the enclosures into a plurality of sub-enclosures; and a plurality of particles, filled in the sub-enclosure.

4. The vibration and noise control method for rail transit based on the modular rail particle damper according to claim 3, wherein the step of selecting, from the plurality of damper modules having the different operating frequencies, the candidate damper module having the operating frequency that matches the vibration frequency component, and taking the candidate damper module as the target damper module, when the vibration frequency component is well matched, wherein the different operating frequencies are configured by providing a number and a shape of the sub-enclosure, selecting a material of the particles and a volume fraction of the sub-enclosure poured into the particles, so as to adjust the operating frequency of a damper module.

5. The vibration and noise control method for rail transit based on the modular rail particle damper according to claim 3, wherein the particles are solid particles and/or liquid medium or combination of both; the volume fraction of the sub-enclosure occupied by the particles is 0-90%.

6. The vibration and noise control method for rail transit based on the modular rail particle damper according to claim 1, wherein each of the plurality of target damper modules has assembly holes arranged;

the connecting module comprises: an end cap, assembly bolts, and assembly nuts; and the step of connecting the plurality of the target damper modules side by side along a longitudinal direction of the rail by a connecting module to form the rail particle damper, comprises:

inserting the assembly bolt through the assembly hole in each of the target damper modules in sequence; wherein a plurality of openings of the enclosures in all of the target damper modules are oriented in a same direction;

applying the end cap to closing the opening of the enclosure in the target damper module;

adopting the assembly nut to lock both ends of the assembly bolt to fix each of the target damper modules so as to form a rail particle damper.

7. The vibration and noise control method for rail transit based on the modular rail particle damper according to claim 1, wherein the rail particle damper is fixed at the rail web by at least two fixtures.

8. The vibration and noise control method for rail transit based on the modular rail particle damper according to claim 7, wherein the fixture comprises:

a base;

an L-shaped part, connecting with the base rotatably;

the L-shaped part comprises:

a horizontal portion and a vertical portion connecting to each other, the horizontal portion limits an upper surface of the rail particle damper, and the vertical portion limits an outer surface of the rail particle damper;

the rail web limits an inner surface of the rail particle damper, and a rail foot limits a lower surface of the rail particle damper.

9. The vibration and noise control method for rail transit based on the modular rail particle damper according to claim 8, wherein the base is a U-shaped seat, and the rail foot locates in the U-shaped seat;

two particle dampers are adopted, and the two rail particle dampers are arranged symmetrically;

two L-shaped parts are adopted, and the two L-shaped parts are arranged symmetrically.

10. The vibration and noise control method for rail transit based on the modular rail particle damper according to claim 8, wherein the horizontal portion is in contact with the upper surface of the rail particle damper; and the L-shaped part has a first mounting screw arranged, which is in contact with the outer surface of the rail particle damper;

the base has a second mounting screw arranged, which is in contact with the outer surface of the rail particle damper.

* * * * *